US007264533B2

(12) United States Patent
Chan et al.

(10) Patent No.: US 7,264,533 B2
(45) Date of Patent: Sep. 4, 2007

(54) BUBBLE-SQUEEZING TOY

(75) Inventors: Cecil Shu On Chan, Hong Kong (CN); Tak Ko Wong, Hong Kong (CN); Lin Tak Chan, Hong Kong (CN)

(73) Assignee: T. K. Wong & Associates Ltd., Kowloon, Hong Kong (CN)

( * ) Notice: Subject to any disclaimer, the term of this patent is extended or adjusted under 35 U.S.C. 154(b) by 0 days.

(21) Appl. No.: 10/871,089

(22) Filed: Jun. 18, 2004

(65) Prior Publication Data

US 2005/0282459 A1 Dec. 22, 2005

(51) Int. Cl.
*A63H 3/06* (2006.01)
*A63H 3/28* (2006.01)

(52) U.S. Cl. ..... 446/183; 446/184

(58) Field of Classification Search ..... 446/176, 446/180–184, 188, 320, 197–198; 119/702, 119/707

See application file for complete search history.

(56) References Cited

U.S. PATENT DOCUMENTS 494,410 A * 3/1893 Carpenter ..... 446/183
1,196,649 A * 8/1916 Bockstahler ..... 446/226
1,352,047 A * 9/1920 Boje, Jr. ..... 446/183
1,461,193 A * 7/1923 Larsen ..... 446/224
1,490,614 A * 4/1924 Loomis ..... 446/189
1,510,554 A * 10/1924 Lee ..... 446/224
1,515,786 A * 12/1924 Munro ..... 446/197
1,725,831 A * 8/1929 Sherman ..... 446/184
1,806,053 A * 5/1931 Gallagher ..... 446/183
2,668,394 A * 2/1954 Auzin ..... 446/183
2,960,794 A * 11/1960 Johns ..... 446/183
4,240,224 A * 12/1980 Katzman et al. ..... 446/197
4,929,211 A * 5/1990 Resnick et al. ..... 446/486
5,205,773 A * 4/1993 Koepcke et al. ..... 446/183
5,338,242 A * 8/1994 Cheng ..... 446/220
5,419,730 A * 5/1995 Diresta et al. ..... 446/193
5,846,116 A * 12/1998 DiResta et al. ..... 446/184
5,921,840 A * 7/1999 Diresta et al. ..... 446/198
6,439,950 B1 * 8/2002 Goldman et al. ..... 446/220
6,572,499 B2 * 6/2003 Davies ..... 473/604
6,672,932 B1 * 1/2004 Panec et al. ..... 446/185
6,935,274 B1 * 8/2005 Rothschild ..... 119/702
7,144,293 B2 * 12/2006 Mann et al. ..... 446/184

FOREIGN PATENT DOCUMENTS

JP 08164280 A * 6/1996

* cited by examiner

*Primary Examiner*—Eugene Kim
*Assistant Examiner*—Alyssa M Hylinski
(74) *Attorney, Agent, or Firm*—Alix, Yale & Ristas, LLP

(57) ABSTRACT

A bubble-squeezing toy includes a hollow body formed of flexible plastics material having low stretchability and an aperture; a liner formed of flexible plastics material having high stretchability and located within the hollow body and having a portion adjacent to the aperture that can stretch through the aperture to form an external bubble upon squeezing of the body.

7 Claims, 10 Drawing Sheets

BUBBLE-SQUEEZING TOY

BACKGROUND OF THE INVENTION

The present invention relates to a bubble-squeezing toy. More particularly, although not exclusively, the invention relates to a hand-held soft toy comprising a body that when squeezed deforms to transfer internally captured air into one or more expanding hemispherical bubble shapes that extend from the body exterior. The invention might also have a mechanical sounding device formed internally thereof to sound when the body is squeezed.

OBJECTS OF THE INVENTION

It is an object of the present invention to provide an interesting and amusing toy that can be squeezed to form expanding hemispherical bubble shapes at its exterior.

DISCLOSURE OF THE INVENTION

There is disclosed herein a bubble-squeezing toy, comprising:

a hollow body formed of flexible plastics material having low stretchability and an aperture, a liner formed of flexible plastics material having high stretchability and located within the hollow body and having a portion adjacent to the aperture that can stretch through the aperture to form an external bubble upon squeezing of the body.

In one embodiment, the body comprises a pair of said apertures and the liner comprises a pair of said portions adjacent to the respective apertures that can stretch therethrough to form a pair of external bubbles upon squeezing of the body.

Preferably, the toy further comprises a pouch located adjacent to the liner within the hollow body and a squeaker extending from the liner to the pouch.

Preferably, the body and liner each comprise sealing plugs.

Preferably, the sealing plug of the body is wider than the sealing plug of the liner and wherein the sealing plugs are adjacent to one another.

There is further disclosed here in a bubble-squeezing toy, comprising:

a hollow body formed of flexible plastics material and having an area of reduced thickness that can stretch to form an external bubble upon squeezing of the body.

Preferably, the body comprises a sealing plug.

There is further disclosed herein a bubble-squeezing toy, comprising:

a hollow body formed of flexible plastics material having an area of reduced thickness, a liner formed of flexible plastics material having an area adjacent to the area of reduced thickness of the body, wherein the adjacent areas can stretch to form a bubble upon squeezing of the body.

Preferably, said area of the hollow body is of reduced thickness.

Preferably, the toy further comprises a pouch located adjacent to the liner within the hollow body and a squeaker extending from the liner to the pouch.

There is further disclosed herein a bubble-squeezing toy, comprising:

a hollow body formed of flexible plastics material having an area of reduced thickness that can expand to form a bubble upon squeezing of the body, a liner formed of flexible plastics material located within the hollow body and separated from the area of reduced thickness by a space, and a squeaker extending from the liner to the space.

There is further disclosed herein a bubble-squeezing toy, comprising:

a hollow body formed of flexible plastics material having low stretchability and a pair of apertures, a pair of liners formed of flexible plastics material having high stretchability and located within the hollow body and having respective portions adjacent to the apertures that can stretch through the apertures to form external bubbles upon squeezing of the body.

Preferably, the toy further comprises a squeaker extending from one of the liners to the other.

Preferably, the body is formed of a material selected from the group consisting of: Polyvinyl Chloride (PVC); Polypropylene (PP); Thermoplastic Rubber (TPR); and Polyethylene (PE).

Preferably, the liner is formed of a material selected from the group consisting of: gelatinous compositions of Styrene Block Copolymers (SBC); Thermoplastic Elastomer (TPE) compounds and alloys; Thermoplastic Polyurethane (TPU) compounds and alloys; Thermoplastic Vulcanizates (TPV) compounds and alloys; Thermoplastic Olefins (TPO) compounds and alloys; and Thermoplastic Rubber (TPR) compounds and alloys.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
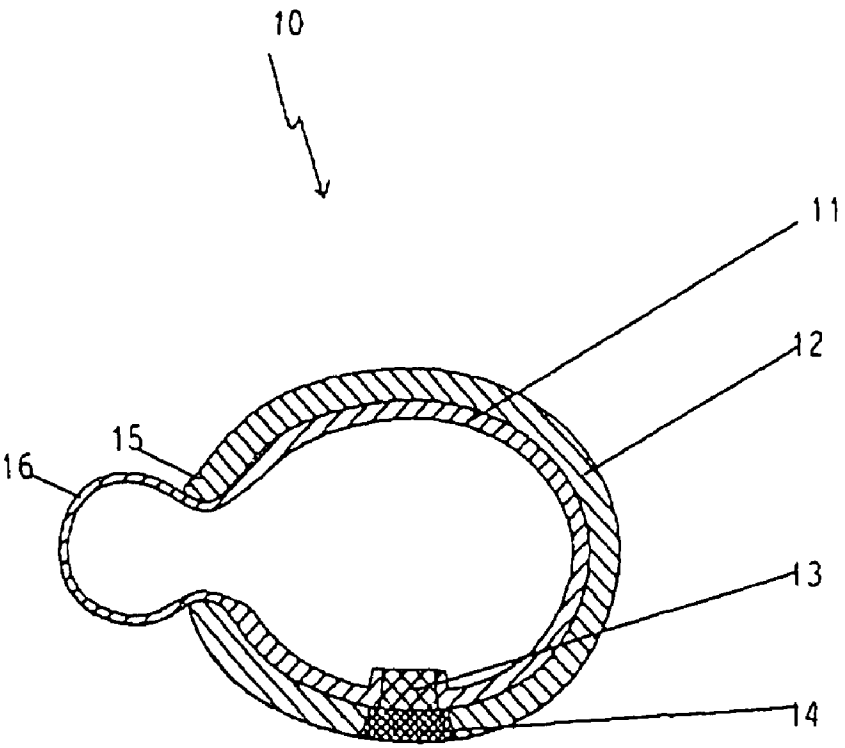
FIG. 1(A) is a schematic cross-sectional elevation of a bubble-squeezing toy in an unsqueezed configuration.
FIG. 1(B) is a schematic cross-sectional elevation of the bubble-squeezing toy of FIG. 1(A) in a squeezed configuration.
Figure 1:
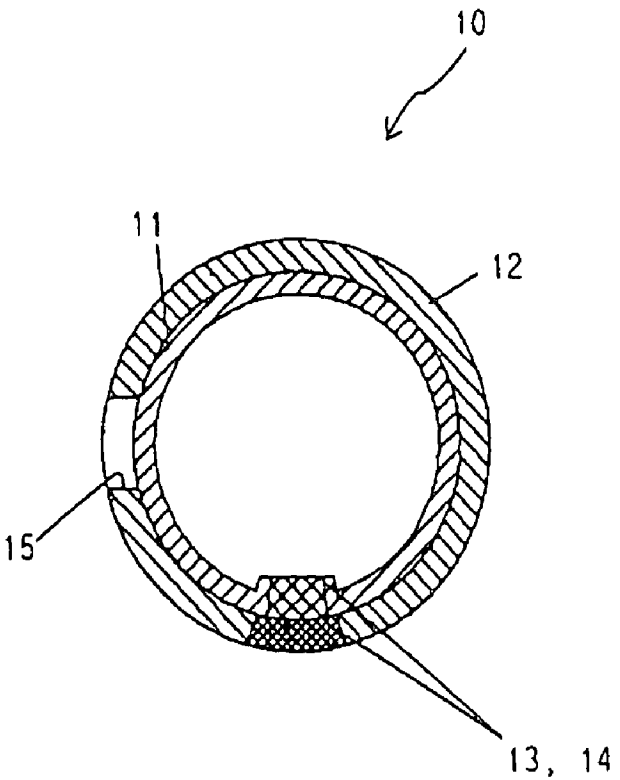

In FIGS. 1(A) and 1(B) of the accompanying drawings there is depicted schematically a bubble-squeezing toy 10 comprising an inner liner 11 surrounded substantially by a body 12. The inner liner 11 is typically formed of a material selected from the group consisting of: gelatinous compositions of Styrene Block Copolymers (SBC); Thermoplastic Elastomer (TPE) compounds and alloys; Thermoplastic Polyurethane (TPU) compounds and alloys; Thermoplastic Vulcanisates (TPV) compounds and alloys; Thermoplastic Olefins (TPO) compounds and alloys; and Thermoplastic Rubber (TPR) compounds and alloys. However, the inner liner could be made of any other flexible plastics material having a high elongation of preferably not less than 300 percent up to about 1600 percent. The material must also have good retraction properties so as to return to the configuration of FIG. 1(A) after squeezing. The thickness of the inner liner is typically between 1 and 3 mm.

The body 12 is typically formed of a material selected from the group consisting of: Polyvinyl Chloride (PVC); Polypropylene (PP); Thermoplastic Rubber (TPR); and Polyethylene (PE). However, the body could be made of any flexible plastics material which can be squeezed or compressed. The elongation properties of the body should be low, and preferably be less than 2-5 percent.

There is an aperture 15 in the body 12 having a diameter typically between 5 mm and 15 mm. The thickness of the body would typically be from 1 mm to 5 mm.

When the body 12 is squeezed, the inner liner stands through the aperture 15 to form a substantially hemispherical bubble 16 as shown in FIG. 1(B).

Upon alternately squeezing and releasing compression quickly, a popping sound will be created from the protruding and retracting bubble.

There are sealing plugs 13 and 14 within respective apertures of the inner liner 11 and body 12. The size of sealing plug 14 is larger than sealing plug 13, but the plugs are aligned so that access to the sealing plug 13 is gained upon removal of the sealing plug 14.

FIGS. 2(A) and 2(B) depict an embodiment 20 which is similar to that of the proceeding figures, but includes a pair of apertures 15A and 15B through which a pair of bubbles 16A and 16B protrude simultaneously upon squeezing of the body 12.

FIGS. 3(A) and 3(B) depict an embodiment 30 having a body similar to that of FIGS. 1(A) and 1(B), but also including within the body 12 a pouch 16 adjacent to a smaller version of the inner liner 11 and communicating therewith via a squeaker 17. In this embodiment, the sealing plug 13 is in the pouch, rather than in the inner liner 11. The pouch would typically be made of the same material from which the inner liner is made. Upon squeezing the body 12, air will pass back and forth through the squeaker 17 as the bubble 16 expands and contracts. The squeaker will produce repeated squeaking sounds. The squeaker 17 comprises a mechanical assembly mounted upon a partition comprising adjacent portions of the liner 11 and pouch 16. The squeaker 17 can be inserted into the body through the sealing plug apertures. Air is then injected into the toy and the plugs are sealed.

Figure 2:
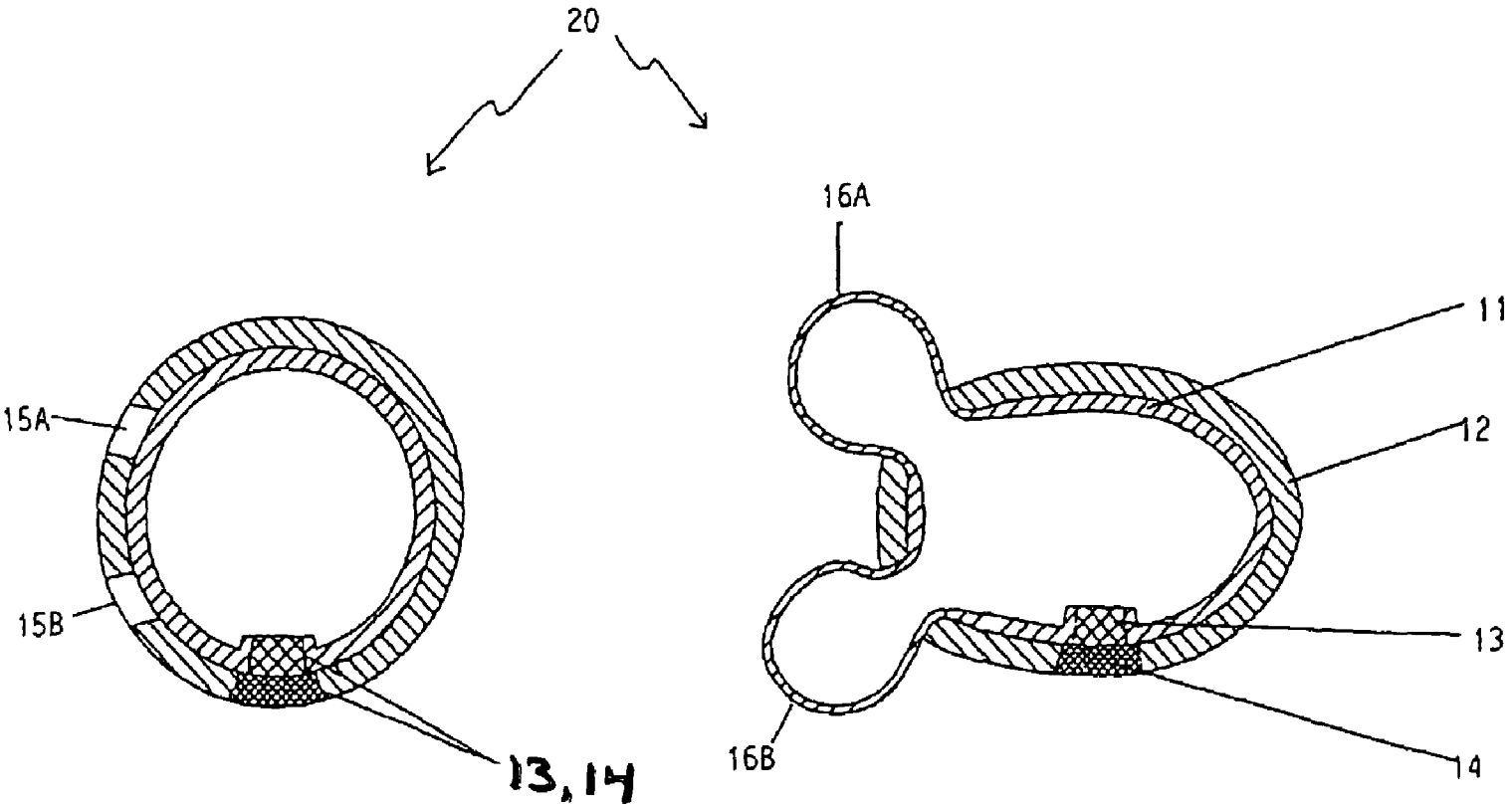
FIG. 2(A) is a schematic cross-sectional elevation of another bubble-squeezing toy in an unsqueezed configuration.
FIG. 2(B) is a schematic cross-sectional elevation of the bubble-squeezing toy of FIG. 2(A) in a squeezed configuration.
Figure 3:
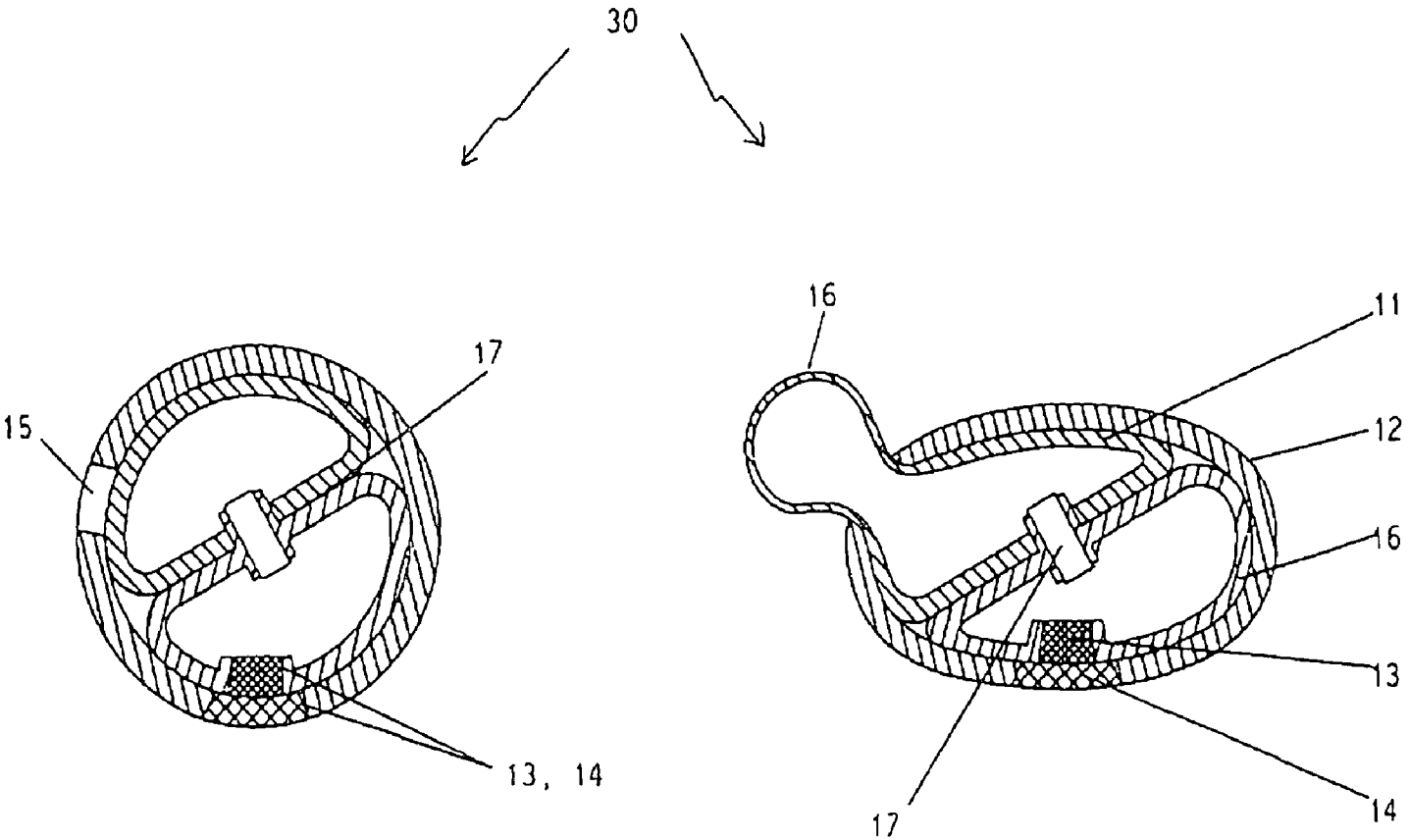
FIG. 3(A) is a schematic cross-sectional elevation of another bubble-squeezing toy in an unsqueezed configuration.
FIG. 3(B) is a schematic cross-sectional elevation of the bubble-squeezing toy of FIG. 3(A) in a squeezed configuration.
Figure 4:
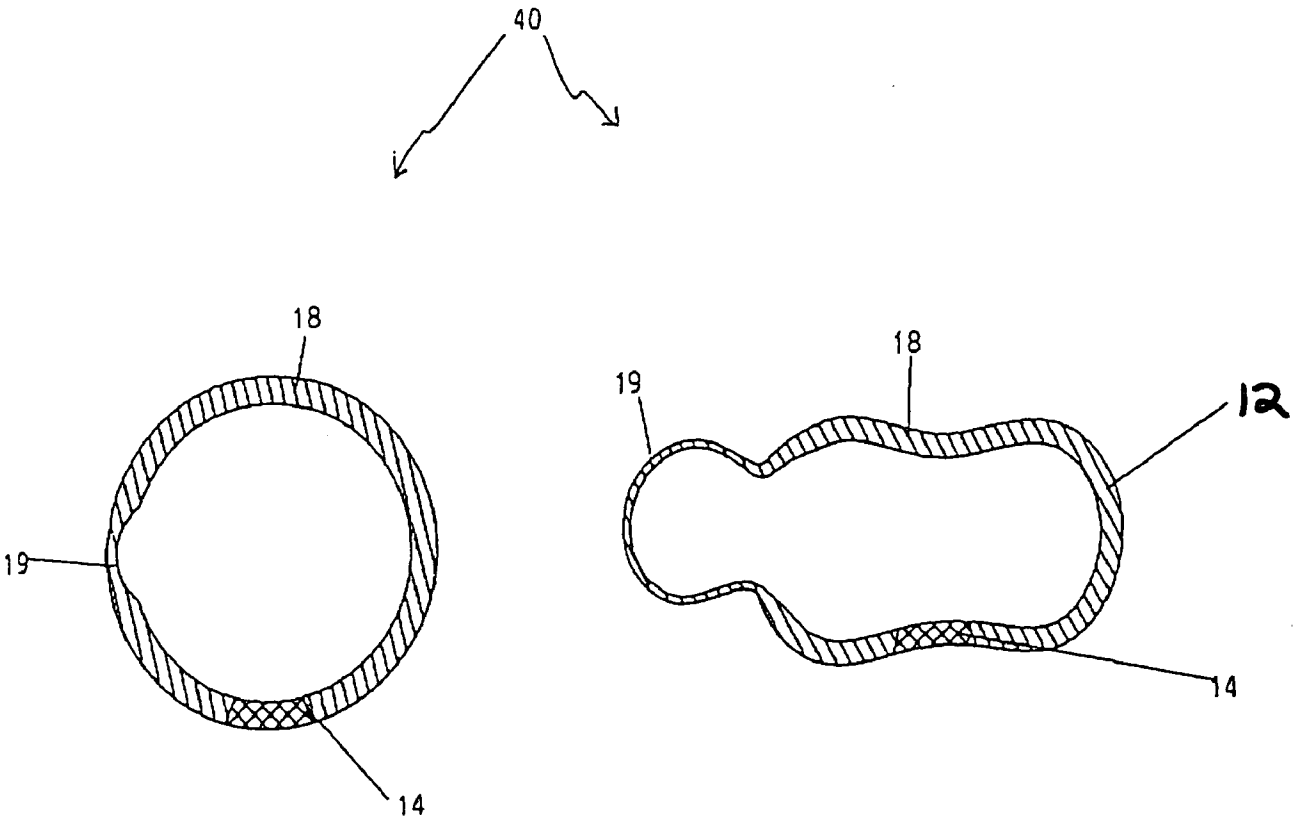
FIG. 4(A) is a schematic cross-sectional elevation of another bubble-squeezing toy in an unsqueezed configuration.
FIG. 4(B) is a schematic cross-sectional elevation of the bubble-squeezing toy of FIG. 4(A) in a squeezed configuration.

FIGS. 4(A) and 4(B) depict a further embodiment 40 in which the body does not house a separate inner liner. Instead, the body whose overall thickness is typically from 3 to 6 mm is provided with a thin area 19 that expands to form a bubble when the body is squeezed. The thin area 19 would typically be 1 to 2 mm thick in the relaxed state as depicted in FIG. 4(A). The material from which the body 18 is formed would typically be chosen from the same group from which the liners of FIGS. 1 to 3 are made. These are all elastomeric materials with high elongation and good retraction properties. By alternately squeezing and releasing the body rapidly, a popping sound will be created from the protruding and retracting bubble.

Figure 5:
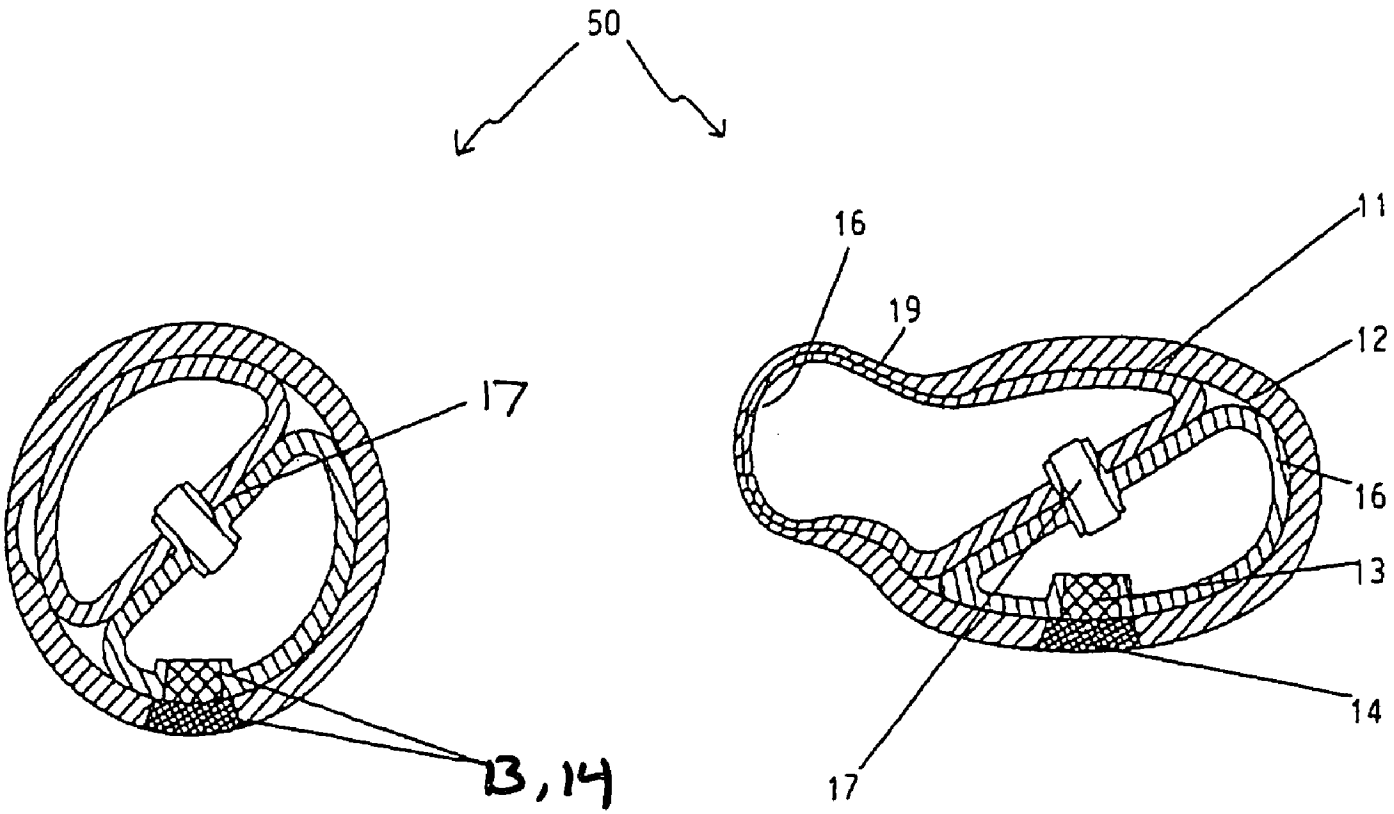
FIG. 5(A) is a schematic cross-sectional elevation of another bubble-squeezing toy in an unsqueezed configuration.
FIG. 5(B) is a schematic cross-sectional elevation of the bubble-squeezing toy of FIG. 5(A) in a squeezed configuration.

FIGS. 5(A) and 5(B) depict an embodiment 50 in which the body is the same as the depicted in FIGS. 4(A) and 4(B), but comprising the internal components the same as those depicted in the embodiment of FIGS. 3(A) and 3(B). The bubble formed by this embodiment is double-lined comprising an inner bubble liner 16 and an outer liner 19. The body 12 as well as the inner liner 11 and pouch 16 would all be formed of the same highly elastic material.

Figure 6:
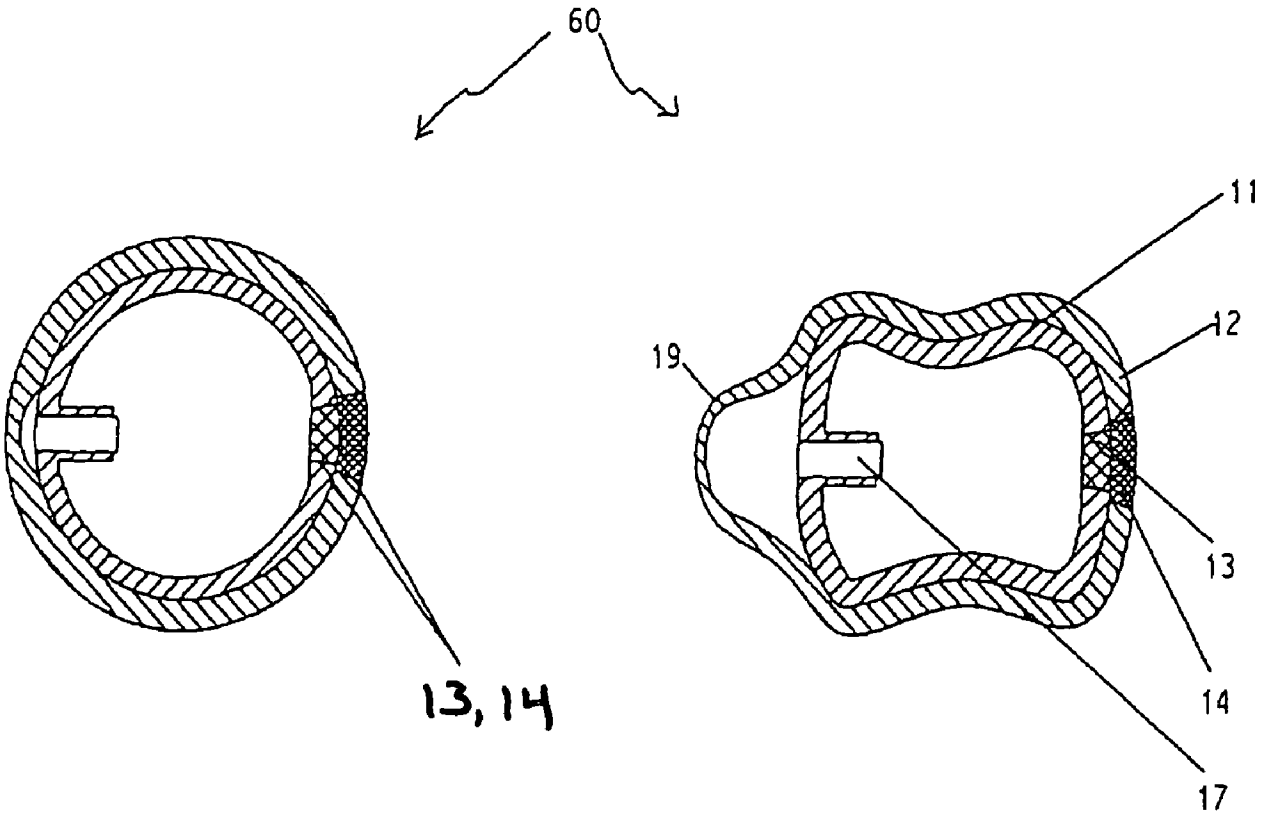
FIG. 6(A) is a schematic cross-sectional elevation of another bubble-squeezing toy in an unsqueezed configuration.
FIG. 6(B) is a schematic cross-sectional elevation of the bubble-squeezing toy of FIG. 6(A) in a squeezed configuration.

The embodiment 60 depicted in FIGS. 6(A) and 6(B) comprises two liners of material. The body or outer liner 12 is of high elastic material with high elongation and good retraction properties and has a thinner bubble-forming portion 19. The inner liner 11 is made of a plastic material—not necessarily having a high elongation, but is nevertheless flexible so as to return to its original shape once hand compression is released. For example, the inner liner might be chosen from a material having low elongation of preferably less than 2 percent. There is a squeaker 17 positioned directly behind the bubble-forming portion 19. When squeezed, air passes from the interior of the inner liner through the squeaker into the bubble-forming volume to expand portion 19 as shown.

Figure 7:
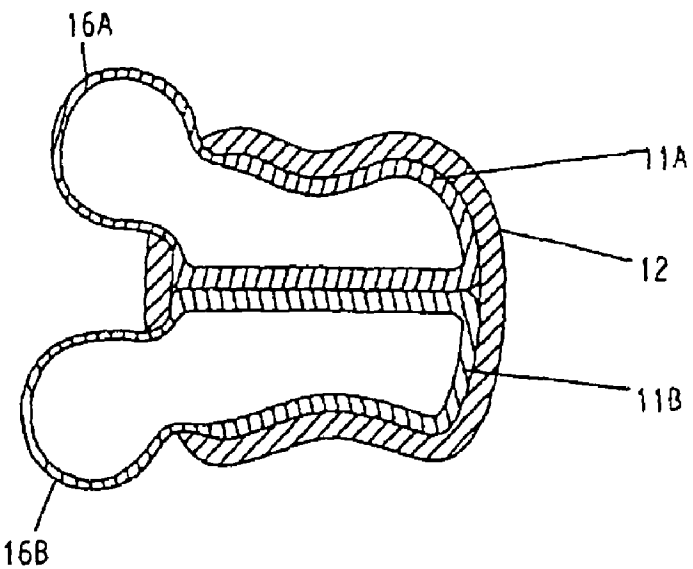
FIG. 7(A) is a schematic cross-sectional elevation of another bubble-squeezing toy in an unsqueezed configuration.
FIG. 7(B) is a schematic cross-sectional elevation of the bubble-squeezing toy of FIG. 7(A) in a squeezed configuration.
Figure 7:
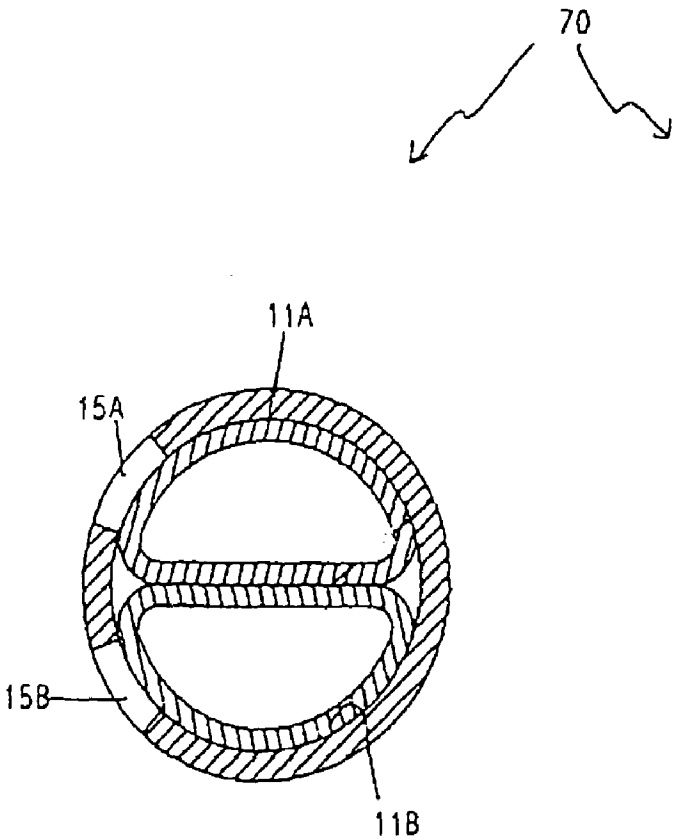

The construction 70 depicted in FIGS. 7(A) and 7(B) is similar to that of FIGS. 2(A) and 2(B), except that there are two separate inner liners 11A and 11B that do not share air. This construction allows a bubbles 16A and 16B to protrude from each respective aperture independently of one another when the body is squeezed.

Figure 8:
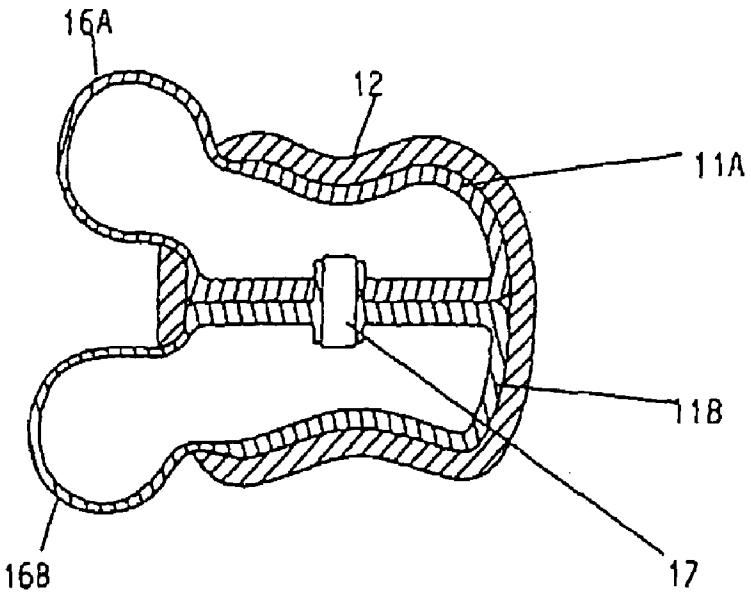
FIG. 8(A) is a schematic cross-sectional elevation of another bubble-squeezing toy in an unsqueezed configuration.
FIG. 8(B) is a schematic cross-sectional elevation of the bubble-squeezing toy of FIG. 8(A) in a squeezed configuration.
Figure 8:
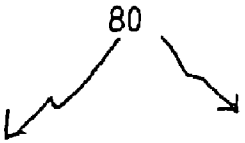
Figure 8:
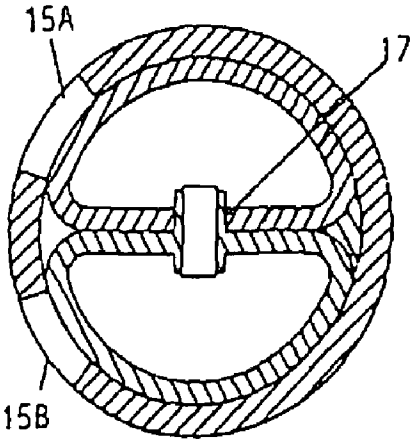

FIGS. 8(A) and 8(B) depict an embodiment 80 the same as that depicted in FIGS. 7(A) and 7(B), except there is a squeaker situated between the two inner liners 11A and 11B.

Figure 9:
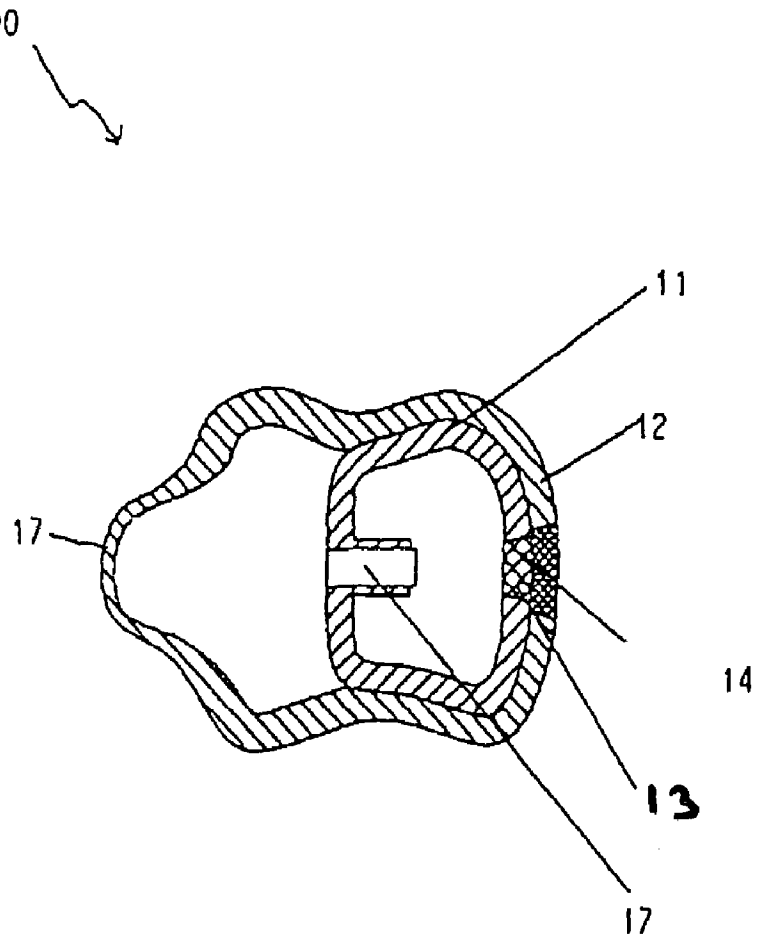
FIG. 9(A) is a schematic cross-sectional elevation of another bubble-squeezing toy in an unsqueezed configuration.
FIG. 9(B) is a schematic cross-sectional elevation of the bubble-squeezing toy of FIG. 9(A) in a squeezed configuration.
Figure 9:
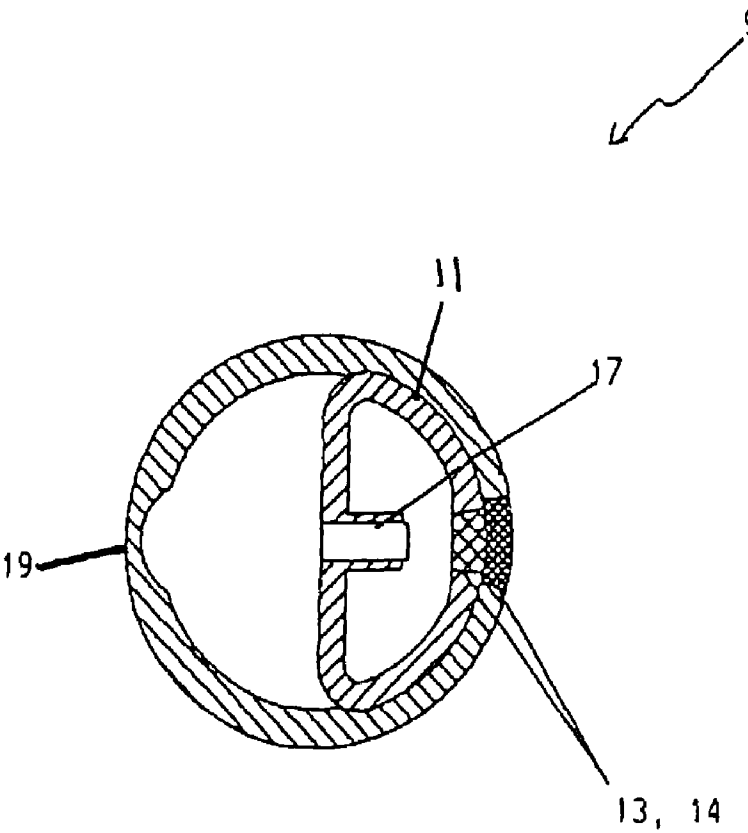

FIGS. 9(A) and 9(B) depict an embodiment 90 somewhat similar to that of FIGS. 6(A) and 6(B), but having an inner liner of reduced volume.

Figure 10:
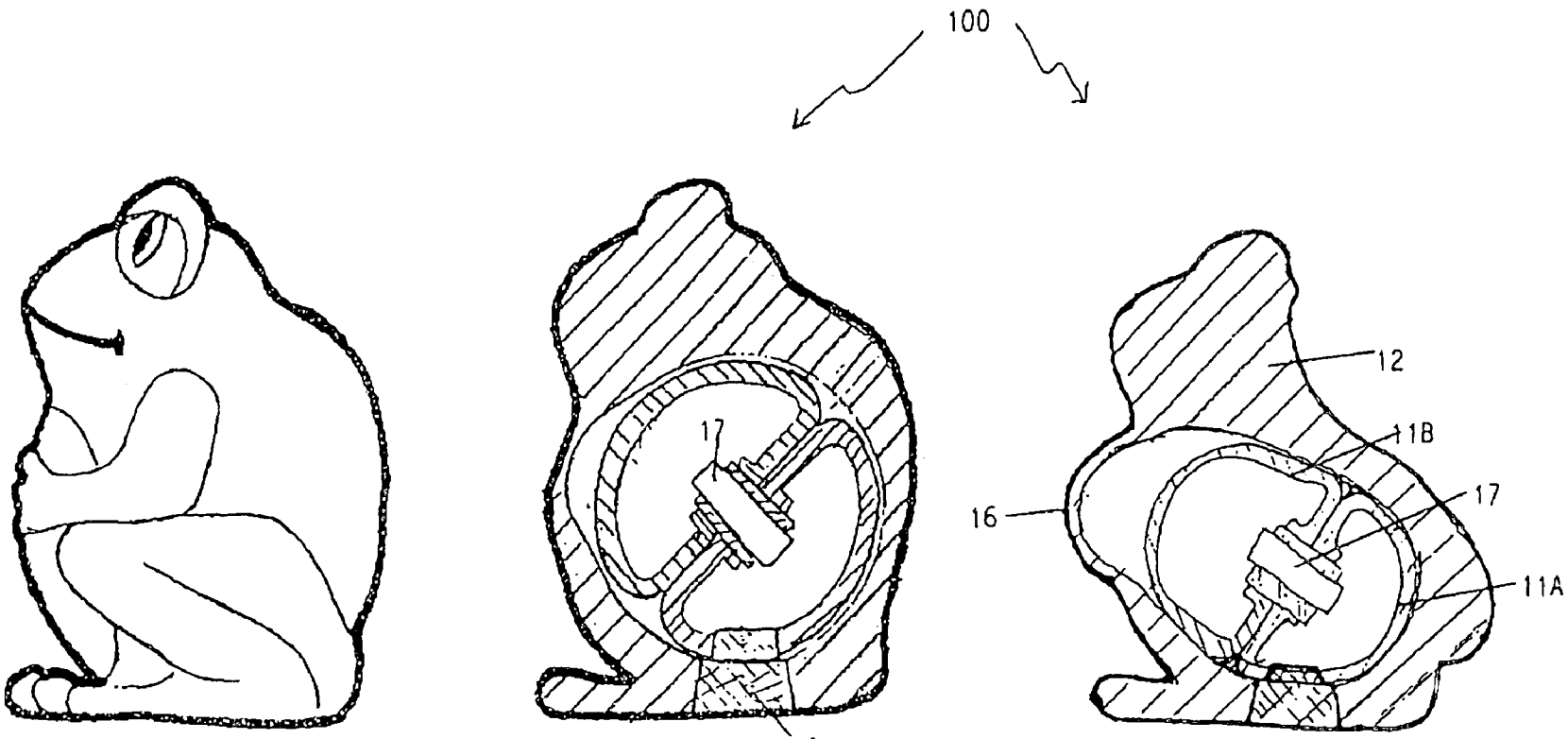
FIG. 10(A) is a schematic elevation of another bubble-squeezing toy in the form of a frog.
FIG. 10(B) is a schematic cross-sectional elevation of the bubble-squeezing toy of FIG. 10(A) in an unsqueezed configuration.
FIG. 10(C) is a schematic cross-sectional elevation of the bubble-squeezing toy of FIGS. 10(A) and 10(B) in a squeezed configuration.

A practical example of the invention is depicted in FIGS. 10(A), 10(B) and 10(C). This practical example is a bubbled belly-popping frog 100. This frog is made in accordance with the construction principles of FIGS. 5(A) and 5(B). Similarly, by applying the constructions as described here into different applications, a wide range of toys such as balls, dolls, animals, birds, insects etc can be made with expanding bubble characteristics with or without additional squeaking sounds as the case may be.

It should be appreciated that modifications and alterations obvious to those skilled in the art are not to be considered as beyond the scope of the present invention. For example, three or more individual inner liners might be provided in which case there might even be more than one squeaker incorporated therebetween.

The invention claimed is:

1. A bubble-squeezing toy, comprising:

a hollow body formed of flexible plastics material having an area of reduced thickness;

a liner formed of flexible plastics material having an area adjacent to the area of reduced thickness of the body, wherein the adjacent areas can stretch to form a bubble upon squeezing of the body; and a pouch located adjacent to the liner within the hollow body and a squeaker extending from the liner to the pouch.

2. The toy of claim 1, wherein said area of the hollow body is of reduced thickness.

3. A bubble-squeezing toy, comprising:

a hollow body formed of flexible plastics material having low stretchability and a pair of apertures;

a pair of liners formed of flexible plastics material having high stretchability and located within the hollow body and having respective portions adjacent to the apertures that can stretch through the apertures to form external bubbles upon squeezing of the body; and a squeaker extending from one of the liners to the other.

4. The toy of claim 3, wherein the body is formed of a material selected from the group consisting of: Polyvinyl Chloride (PVC); Polypropylene (PP); Thermoplastic Rubber (TPR); and Polyethylene (PE).

5. The toy of claim 1, wherein the body is formed of a material selected from the group consisting of: Polyvinyl Chloride (PVC); Polypropylene (PP); Thermoplastic Rubber (TPR); and Polyethylene (PE).

6. The toy of claim 3 wherein the liner is formed of a material selected from the group consisting of: gelatinous compositions of Styrene Block Copolymers (SBC); Thermoplastic Elastomer (TPE) compounds and alloys; Thermoplastic Polyurethane (TPU) compounds and alloys; Thermoplastic Vulcanisates (TPV) compounds and alloys; Thermoplastic Olefins (TPO) compounds and alloys; and Thermoplastic Rubber (TPR) compounds and alloys.

7. The toy of claim 1 wherein the liner is formed of a material selected from the group consisting of: gelatinous compositions of Styrene Block Copolymers (SBC); Thermoplastic Elastomer (TPE) compounds and alloys; Thermoplastic Polyurethane (TPU) compounds and alloys; Thermoplastic Vulcanisates (TPV) compounds and alloys; Thermoplastic Olefins (TPO) compounds and alloys; and Thermoplastic Rubber (TPR) compounds and alloys.

* * * * *